US005232612A

United States Patent [19]

Trinh et al.

[11] Patent Number: 5,232,612

[45] Date of Patent: * Aug. 3, 1993

[54] SOLID, PARTICULATE FABRIC SOFTENER WITH PROTECTED, DRYER-ACTIVATED, CYCLODEXTRIN/PERFUME COMPLEX

[75] Inventors: Toan Trinh, Maineville; Dennis R. Bacon, Milford, both of Ohio

[73] Assignee: The Procter & Gamble Company, Cincinnati, Ohio

[ * ] Notice: The portion of the term of this patent subsequent to Jan. 5, 2010 has been disclaimed.

[21] Appl. No.: 751,402

[22] Filed: Aug. 28, 1991

[51] Int. Cl.[5] ..... D06M 10/08; C11D 17/00

[52] U.S. Cl. ..... 252/8.6; 252/8.7; 252/875; 252/8.8; 252/8.9; 252/174.11

[58] Field of Search ..... 252/8.6, 8.7, 8.75, 252/8.8, 8.9, 174.11

[56] References Cited

U.S. PATENT DOCUMENTS

| | | | |
|---|---|---|---|
| 2,799,241 | 7/1957 | Wurster | 118/24 |
| 3,196,827 | 7/1965 | Wurster | 118/24 |
| 3,253,944 | 5/1966 | Wurster | 117/100 |
| 3,442,092 | 5/1969 | Gaiser | 252/8.6 |
| 3,928,213 | 12/1975 | Temple et al. | 252/8.8 |
| 3,975,280 | 8/1976 | Hachmann et al. | 252/102 |
| 4,075,110 | 2/1978 | Duffin | 252/8.8 |
| 4,136,038 | 1/1979 | Pracht et al. | 252/8.8 |
| 4,187,184 | 2/1980 | Becker et al. | 252/8.8 |
| 4,661,267 | 4/1987 | Dekker et al. | 252/8.8 |
| 4,678,598 | 7/1987 | Ogino et al. | 252/174.14 |
| 4,828,746 | 5/1989 | Clauss et al. | 252/90 |
| 4,917,920 | 4/1990 | Ono et al. | 427/389.9 |
| 4,992,198 | 2/1991 | Nebashi et al. | 252/174.11 |
| 5,078,904 | 1/1992 | Behan et al. | 252/8.6 |
| 5,094,761 | 3/1992 | Trinh et al. | 252/8.8 |
| 5,102,564 | 4/1992 | Gardlik et al. | 252/8.8 |
| 5,137,646 | 8/1992 | Schmidt et al. | 252/8.8 |
| 5,139,687 | 8/1992 | Borcher et al. | 252/8.6 |

FOREIGN PATENT DOCUMENTS

| | | |
|---|---|---|
| 3020269 | 1/1981 | Fed. Rep. of Germany . |
| 63-035517 | 2/1988 | Japan . |

OTHER PUBLICATIONS

"Microencapsulation Techniques, Applications and Problems," Nack, J. Soc. Cosmetic Chemists, 21, pp. 85–98 (Feb. 4, 1970).

*Primary Examiner*—Paul Lieberman
*Assistant Examiner*—William S. Parks
*Attorney, Agent, or Firm*—Robert B. Aylor

[57] ABSTRACT

Fabric softening compositions, preferably in liquid form, for use in the rise cycle of home laundry operations are improved by: (a) using certain protected water sensitive materials, especially particulate complexes of cyclodextrins and perfumes, which are protected in fabric softening compositions and/or detergent compositions, by e.g., imbedding said particulate complex in relatively high melting protective material that is substantially water-insoluble and, preferably, non-water-swellable and is solid at normal storage conditions, but which melts at the temperatures encountered in automatic fabric dryers (laundry dryers); (b) using soil release polymers to help suspend water-insoluble particles in aqueous fabric softening compositions: and/or (c) preparing the said protected particulate water sensitive materials (complexes) by melting the said high melting materials, dispersing the said particulate complexes, or other water sensitive material, in the molten high melting protective material and dispersing the resulting molten mixture in aqueous media, especially surfactant solution or aqueous fabric softener composition, and cooling to form small, smooth, spherical particles of the particulate complexes, or other water sensitive material, substantially protected by the high melting material.

13 Claims, No Drawings

SOLID, PARTICULATE FABRIC SOFTENER WITH PROTECTED, DRYER-ACTIVATED, CYCLODEXTRIN/PERFUME COMPLEX

TECHNICAL FIELD

This invention relates to compositions and methods for softening fabrics during the rinse cycle of home laundering operations. This is a widely used practice to impart to laundered fabrics a texture, or hand, that is smooth, pliable and fluffy to the touch (i.e., soft). The invention also relates to the protection of water sensitive materials.

BACKGROUND ART

Fabric softening compositions, and especially liquid fabric softening compositions, have long been known in the art and are widely utilized by consumers during the rinse cycles of automatic laundry operations. The term "fabric softening" as used herein and as known in the art refers to a process whereby a desirably soft hand and fluffy appearance are imparted to fabrics.

Rinse-added fabric softening compositions normally contain perfumes to impart a pleasant odor to the treated fabrics. It is desirable to have improved perfume retention for extended odor benefits.

Perfume delivery via the liquid rinse added fabric conditioning compositions of the invention in automatic laundry washers is desirable in two ways. Product malodors can be covered by the addition of even low levels of free perfume to the softener composition, and free perfume can be transferred onto fabrics with the softener actives in the rinse cycle. Present technologies add free perfume directly into the softener compositions independent of the other softener components, or in microcapsules formed, e.g., by coacervation techniques. Such encapsulated perfume can deposited on fabric in the rinse and be retained after the drying process for relatively long periods of time. However, such microcapsules that survive the laundry processing are often difficult to rupture, and free perfume that is released after the capsules rupture does not provide a noticeable rewet odor benefit.

Addition of free perfume into the softener composition allows the perfume to freely migrate creating an unstable condition and free perfume deposited on fabric dissipates fairly quickly in the drying cycle and when the fabrics are stored. If one wishes to have the perfume on fabric to last longer in storage or during wearing, it usually requires deposition of more perfume onto fabric in the laundry process. Higher deposition typically requires starting with an undesirably high level of perfume in the product and the resulting initial fabric odor is usually too strong. There have been many previous attempts to protect perfume to prevent excessive odor in fabric care products and on the fabrics themselves immediately after the washing cycle is completed, while having a delayed release of perfume from the fabrics when they are being used.

Compositions containing cationic nitrogenous compounds in the form of quaternary ammonium salts and/or substituted imidazolinium salts having two long chain acyclic aliphatic hydrocarbon groups are commonly used to provide fabric softening benefits when used in laundry rinse operations (See, for example, U.S. Pat. Nos.: 3,644,203, Lamberti et al., issued Feb. 22, 1972; and 4,426,299, Verbruggen, issued Jan. 17, 1984, said patents being incorporated herein by reference; also "Cationic Surface Active Agents as Fabric Softeners," R. R. Egan, Journal of the Americal Oil Chemists' Society, January 1978, pages 118–121; and "How to Choose Cationics for Fabric Softeners," J. A. Ackerman, Journal of the American Oil Chemists' Society, June 1983, pages 1166–1169).

Quaternary ammonium salts having only one long chanin acyclic aliphatic hydrocarbon group (such as monostearyltrimethyl ammonium chloride) are less commonly used because for the same chain length, compounds with two long alkyl chains were found to provide better softening performance than those having one long alkyl chain. (See, for example, "Cationic Fabric Softeners," W. P. Evans, Industry and Chemistry, July 1969, pages 893–903). U.S. Pat. No. 4,464,272, Parslow et al., issued Aug. 7, 1984, incorporated herein by reference, also teaches that monoalkyl quaternary ammonium compounds are less effective softeners.

Another class of nitrogenous materials that are sometimes used in fabric softening compositions are the nonquaternary amide-amines. A commonly cited material is the reaction product of higher fatty acids with hydroxyalkylalkylenediamines. An example of these materials is the reaction product of higher fatty acids and hydroxyethylethylenediamine (See "Condensation Products from β-Hydroxyethylethylenediamine and Fatty Acids or Their Alkyl Esters and Their Application as Textile Softeners in Washing Agents," H. W. Eckert, Fette-Seifen-Anstrichmitte], September 1972, pages 527–533). These materials are usually cited generically along with other cationic quaternary ammonium salts and imidazolinium salts as softening actives in fabric softening compositions. (See U.S. Pat. Nos. 4,460,485, Rapisarda et al., issued Jul. 17, 1984; 4,421,792, Rudy et al., issued Dec. 20, 1983; 4,327,133, Rudy et al., issued Apr. 27, 1982, all of said patents being incorporated herein by reference). U.S. Pat. No. 3,775,316, Berg et al., issued Nov.27, 1973, incorporated herein by reference, discloses a softening finishing composition for washed laundry containing (a) the condensation product of hydroxyalkylalkylpolyamine and fatty acids and (b) a quaternary ammonium compound mixture of (i) from 0% to 100% of quaternary ammonium salts having two long chain alkyl groups and (ii) from 100% to 0% of a germicidal quanternary ammonium compound of the formula $[R^5R^6R^7R^8N]+A^-$ wherein $R_5$ is a long chain alkyl group, $R_6$ is a member selected from the group consisting of arylalkyl group and $C_3$–$C_{18}$ alkenyl and alkadienyl containing one or two C=C double bounds, $R_7$ and $R_8$ are $C_1$–$C_7$ alkyl groups, and A is an anion. U.S. Pat. No. 3,904,533, Neiditch et al., issued Sep. 9, 1975, incorporated herein by reference, teaches a fabric conditioning formulation containing a fabric softening compound and a low temperature stabilizing agent which is a quaternary ammonium salt containing one to three short chain $C_{10}$–$C_{14}$ alkyl groups; the fabric softening compound is selected from a group consisting of quaternary ammonium salts containing two or more long chanin alkyl groups, the reaction product of fatty acids and hydroxyalkyl alkylene diamine, and other cationic materials.

SUMMARY OF THE INVENTION

The present invention relates primarily to fabric softening compositions, preferably in liquid form, for use in the rinse cycle of home laundry operations. The present invention is based, at least in part, on: (a) the discovery that certain particulate water sensitive material such as particulate complexes of cyclodextrins and perfumes, as described more fully hereinafter, can be protected, even for extended periods, in hostile environments such as liquid fabric softening compositions, laundry wash solutions, laundry rinse water, etc., by relatively high melting, water-insoluble (and preferably non-water-swellable), protective material that is solid at normal storage conditions, but which melts at the temperatures encountered in automatic fabric dryers (laundry dryers), said water sensitive materials, e.g., particulate complexes typically being imbedded in said protective material which is in particulate form (e.g., protected particulate cyclodextrin complexes); (b) the discovery that soil release polymers, and especially polyester soil release polymers as described in detail hereinafter, can help suspend water-insoluble particles, including the protected particulate cyclodextrin complexes of (a), in aqueous fabric softening compositions; and/or (c) the discovery of a process in which said protective materials are melted and dispersed in water with particulate water sensitive material, and cooled to form small, smooth, spherical protected particles containing the water sensitive material which is at least partially enrobed by said protective material. Said protective material, described in detail hereinafter, is relatively insoluble in aqueous liquids, especially fabric softener compositions and is preferably not swollen by said aqueous liquids (non-water-swellable). Preferably, the protected particles of (a) are suspended by the soil release polymer of (b).

The protected particles of (a) become attached to fabrics in the rinse cycle and the protective materials soften in an automatic laundry dryer cycle to free the cyclodextrin/perfume complex in the dryer, and attach said complex to the fabric during the drying step. The perfume is retained in the complex until subsequent rewetting release the perfume. Thus, this invention expands the benefits of the invention described in copending U.S. Pat. application Ser. No. 07/337,036, filed Apr. 12, 1989, for Treatment of Fabrics with Perfume/-Cyclodextrin Complexes, said application being incorporated herein by reference.

More specifically, fabric softening compositions are provided in the form of aqueous dispersions comprising from about 3% to about 35% by weight of fabric softener, and from about 0.5 % to about 25%, preferably from about 1% to about 15% of protected particles comprising particulate cyclodextrin/perfume complex which is protected by an effective amount of protective material that is substantially water-insoluble and non-water-swellable, and has a melting point of from about 30° C. to about 90° C., preferably from about 35° C. to about 80° C., the protected complex particles preferably being stably dispersed in said aqueous composition by an effective amount of soil release polymer. The pH (10% solution) of such compositions is typically less than about 7, and more typically from about 2 to about 6.5.

DETAILED DESCRIPTION OF THE INVENTION

The amount of fabric softening agent in the composition of this invention is typically from about 3% to about 35%, preferably from about 4% to about 27%, by weight of the composition. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

Some preferred compositions are disclosed in U.S. Pat. No. 4,661,269, issued Apr. 28, 1987, in the names of Toan Trinh, Errol H. Wahl, Donald M. Swartley and Ronald L. Hemingway, said patent being incorporated herein by reference.

The Liquid Composition

Liquid, preferably aqueous, fabric softening compositions typically comprise the following components:

I. from about 3% to about 35%, preferably from about 4% to about 27%, by weight of the total composition of fabric softener;

II. from about 0.5% to about 25%, preferably from about 1% to about 15%, more preferably from about 1% to about 5%, of protected particulate cyclodextrin/perfume complex, said complex being effectively protected by solid, substantially water-insoluble and substantially non-water-swellable protective material that melts at a temperature between about 30° C. and about 90° C.; the said protective material being from about 50% to about 1000%, preferably from about 100% to about 500%, more preferably from about 150% to about 300%, by weight of said cyclodextrin/perfume complex;

III. from 0% to about 5% of polymeric soil release agent, preferably in an effective amount to stably suspend the protected particulate cyclodextrin/-perfume complex II in the composition; and IV. the balance comprising liquid carrier selected from the group consisting of water, $C_1$–$C_4$ monohydric alcohols, $C_2$–$C_6$ polyhydric alcohols, liquid polyalkylene glycols, and mixtures thereof.

One suitable fabric softener (Component I) is a mixture comprising:

(a) from about 10% to about 80% of the reaction product of higher fatty acids with a polyamine selected from the group consisting of hydroxyalkylalkylenediamines and dialkylenetriamines and mixtures thereof;

(b) from about 3% to about 40% of cationic nitrogenous salts containing only one long chain acyclic aliphatic $C_{15}$–$C_{22}$ hydrocarbon group; and optionally, (c) from 10% to about 80% of cationic nitrogenous salts having two or more long chain acyclic aliphatic $C_{15}$–$C_{22}$ hydrocarbon groups or one said group and an arylalkyl group;

said (a), (b) and (c) percentage being by weight of Component I.

Following are the general descriptions of the essentials and optionals of the present compositions including specific examples. The examples are provided herein for purposes of illustration only.

DESCRIPTION OF THE INVENTION

1. Cyclodextrins

As used herein, the term "cyclodextrin" (CD) includes any of the known cyclodextrins such as unsubstituted cyclodextrins containing from six to twelve glucose units, especially, alpha-, beta-, gamma-cyclodextrins, and mixtures thereof, and/or their derivatives, including branched cyclodextrins, and/or mixtures thereof, that are capable of forming inclusion complexes with perfume ingredients. Alpha-, beta, and gamma-cyclodextrins can be obtained from, among others, American Maize-Products Company (Amaizo), Corn Processing Division, Hammond, Ind.; and Roquette Corporation, Gurnee, Ill. There are many derivatives of cyclodextrins that are known. Representative derivatives are those disclosed in U.S. Pat. Nos.: 3,426,011, Parmerter et al., issued Feb. 4, 1969; 3,453,257, 3,453,258, 3,453,259, and 3,453,260, all in the names of Parmerter et al.., and all issued Jul. 1, 1969; 3,459,731, Gramera et al., issued Aug. 5, 1969; 3,553,191, Parmerter et al., issued Jan. 5, 1971; 3,565,887, Parmerter et al., issued Feb. 3, 1971; 4,535,152, Szejtli et al., issued Aug. 13, 1985; 4,616,008, Hirair et al., issued Oct. 7, 1986; 4,638,058, Brandt et al., issued Jan. 20, 1987; 4,746,734, Tsuchiyama et al., issued May 24, 1988; and 4,678,598, Ogino et al., issued Jul. 7, 1987, all of said patents being incorporated herein by reference. Examples of cyclodextrin derivaties suitable for use herekin are methyl-β-CD, hydroxyethyl-β-CD, and hydroxypropyl-β-CD of different degrees of substitution (D.S.), available from Amaizo and from Aldrich Chemical Company, Milwaukee, Wis.

The individual cyclodextrins can also be linked together, e.g., using multifuncational agents to form oligomers, cooligomers, polymers, copolymers, etc. Examples of such materials are available commercially from Amaizo and from Aldrich Chemical Company (β-CD/epichlorohydrin copolymers).

It is also desirable to use mixtures of cyclodextrins and/or precursor compounds to provide a mixture of complexes. Such mixtures, e.g., can provide more even odor profiles by encapsulating a wider range of perfume ingredients and/or preventing formation of large crystals of said complexes. Mixtures of cyclodextrins can conveniently be obtained by using intermediate products from known process for the preparation of cyclodextrins including those processes described in U.S. Pat. Nos.: 3,425,910, Armbruster et al., issued Feb. 4, 1969; 3,812,011, Okada et al., issued May 21, 1974; 4,317,881, Yagi et al., issued Mar. 2, 1982; 4,418,144, Okada et al., issued Nov. 29, 1983; and 4,738,923, Ammeraal, issued Apr. 19, 1988, all of said patents being incorporated herein by reference. Preferably at least a major portion of the cyclodextrins are alpha-cyclodextrin, beta-cyclodextrin, and/or gamma/cyclodextrin, more preferably beta-cyclodextrin. Some cyclodextrin mixtures are commercially available from, e.g., Ensuiko Sugar Refining Company, Yokohama, Japan.

2. PERFUMES

Fabric softening products typically contain some perfume to provide some fragrance to provide an alfactory aesthetic benefit and/or to serve as a signal that the product is effective. However, the perfume in such products is often lost before it is needed. Perfumes can be subject to damage and/or loss by the action of, e.g., oxygen, ligyt, heat, etc. For example, due to the large amount of water used in the rinse cycle of a typical automatic washing machine and/or the high energy input and large air flow in the drying process used in the typical automatic laundry dryers, a large part of the perfume provided by fabric softener products has been losts. The loss occurs when the perfume is either washed out with the rinse water and/or lost out the dryer vent. Even for less volatile components, as described hereinafter, only a small fraction remains on the fabrics after the washing and drying cycles are completed. The loss of the highly volatile fraction of the perfume, as described hereinafter, is much higher. Usually the loss of the highly volatile fraction is practically total. Due to this effect, many perfumes used in, e.g., dryer-added fabric softener compositions, have been composed mainly of less volatile, high boiling (having high boiling points), perfume components to maximize survival of the odor character during storage and use and thus provide better "fabric substantivity.". The main function of a small fraction of the highly volatile, low boiling (having low boiling points), perfume components in these perfumes is to improve the fragrance odor of the product itself, rather than impacting on the subsequent fabric odor. However, some of the volatile, low boiling perfume ingredients can provide a fresh and clean impression to the substrate, and it is highly desirable that these ingredients be deposited and present on the fabric.

The perfume ingredients and compositions of this invention are the conventional ones known in the art. Selection of any perfume component, or amount of perfume, it based soley on aesthetic considerations. Suitable perfume compounds and compositions can be found in the art including U.S. Pat. Nos.: 4,145,184, Brian and Cumminas, issued Mar. 20, 1979; 4,209,417, Whyte, issued Jun. 24, 1980; 4,515,705, Moeddel, issued May, 7, 1985; and 4,152,272, Young, issued May 1, 1979, all of said patents being incorporated herein by reference. Many of the art recognized perfume compositions are relatively substantive, as described hereinafter, to maximize their odor effect on fabrics. However, it is a special advantage of perfume delivery via the perfume/cyclodextrin complexes that nonsubstantive perfumes are also effective.

A substantive perfume is one that contains a sufficient percentage of substantive perfume materials so that when the perfume is used at normal levels in products, it deposits a desired odor on the treated fabric. In general, the degree of substantivity of a perfume is roughly proportional to the percentage of substantive perfume material used. Relatively substantive perfumes contain at least about 1%, preferably at least about 10%, substantive perfume materials.

Substantive perfume materials are those odorous compounds that deposit on fabrics via the treatment process and are detectable by people with normal olfactory acuity. Such materials typically have vapor pressures lower than that of the average perfume material. Also, they typically have molecular weights of about 200 or above, and are detectable at levels below those of the average perfume material.

3. COMPLEX FORMATION

The complexes of this invention are formed in any of the ways known in the art. Typically, the complexes are formed either by bringing the perfume and the cyclodextrin together as solutions in suitable solvents, preferably water, or in suspension or by kneading the ingredients together in the presence of a suitable, preferably minimal, amount of solvent, preferably water. Other polar solvents such as ethanol, methanol, isopropanol, etc., and mixtures of said polar solvents with themselves and/or with water can be used as solvents for complex formation. The use of such solvents in complex formation has been disclosed in an article in *Chemistry Letters* by A. Harada and S. Takahashi, pp.

2089–2090 (1984), said article being incorporated herein by reference. The suspension/kneading method is particularly desirable because less solvent is needed and therefore less separation of the solvent is required. Suitable processes are disclosed in the patents incorporatexd hereinbefore by reference. Additional disclosures of complex formation can be found in Atwood, J. L., J. E. D. Davies & D. D. MacNichol, (Ed.): *Inclusion Compounds, Vol. III*, Academic Press (1984), especially Chapter 11; Atwood J. L. and J. E. D. Davies (Ed.): *Proceedings of the Second International Symposium of Cyclodextrins* Tokyo, Japan, (July, 1984); *Cyclodextrin Technolgoy*, J. Szejtli, Kluwer Academic Publishers (1988); all of said publications being incorporated by reference.

In general, perfume/cyclodextrin complexes have a molar ratio of perfume to cyclodextrin of 1:1. However, the molar ratio can be either higher or lower, depending on the molecular size of the perfume and the identity of the cyclodextrin compound. The molar ratio can be determined by forming a saturated solution of the cyclodextrin and adding the perfume to form the complex. In general the complex will precipitate readily. If not, the complex can usually be precipitated by the addition of electrolyte, change of pH, cooling, etc. The complex can then be analyzed to determine the ratio of perfume to cyclodextrin.

As stated hereinbefore, the actual complexes are determined by the size of the cavity in the cyclodextrin and the size of the perfume molecule. Although the normal complex is one molecule of perfume in one molecule of cyclodextrin, complexes can be formed between one molecule of perfume and two molecules of cyclodextrin when the perfume molecule is large and contains two portions that can fit in the cyclodextrin. Highly desirable complexes can be formed using mixtures of cyclodextrins since some perfumes are mixtures of compounds that vary widely in size. It is usually desirable that at least a majority of the cyclodextrin be alpha-, beta-, and/or gamma-cyclodextrin, more preferably beta-cyclodextrin.

Process for the production of cyclodextrins and complexes are described in U.S. Pat. Nos.: 3,812,011, Okada, Tsuyama, and Tsuyama, issued May 21, 1974; 4,317,881, Yagi, Kouno and Inui, issued Mar. 2, 1982; 4,418,144, Okada, Matsuzawa, Uezima, Nakakuki, and Horikoshi, issued Nov. 29, 1983; 4,378,923, Ammeraal, issued Apr. 19, 1988, all of said patents being incorporated herein by reference. Materials obtained by any of these variations are acceptable for the purposes of this invention. It is also acceptable to initially isolate the inclusion complexes directly from the reaction mixture by crystallization.

Continuous operation usually involves the use of supersaturated solutions, and/or suspension/kneading, and/or temperature manipulation, e.g., heating and then cooling and drying. In general, the fewest possible process steps are used to avoid loss of perfume and excessive processing costs.

4. COMPLEX PARTICLE SIZES

The particle sizes of the complexes are selected according to the desired perfume release profile. Small particles, e.g., from about 0.01 μm to about 15 μm, preferably from about 0.01 μm to about 8 μm, more preferably from about 0.05 μm to about 5 μm, are desirable for providing a quick release of the perfume when the dried fabrics are rewetted. It is a special benefit of this invention that small particles can be maintained by, e.g., incorporation of the cyclodextrin in the encapsulating material to make the larger agglomerates that are desired for attachment to the fabric. These small particles are conveniently prepared initially by the suspension/kneading method. Larger particles, e.g., those having particle sizes of from about 15 μm to about 500 μm preferably from about 15 μm to about 250 μm, more preferably from about 15 μm to about 50 μm, are unique in that they can provide either slow release of perfume when the substrates are rewetted with a large amount of water or a series of releases when the substrates are rewetted a plurality of times. The larger particle size complexes are conveniently prepared by a crystallization method in which the complexes are allowed to grow, and large particles are ground to the desired sizes if necessary. Mixtures of small and large particles can give a broader active profile. Therefore, it can be desirable to have substantial amounts of particles both below and above 15 microns.

5. THE PROCTECTIVE MATERIAL

The protective material is selected to be relatively unaffected by aqueous media and to melt at temperatures found in the typical automatic laundry dryer. Surprisingly, the protective material survives storage, e.g., in liquid fabric softener compositions; protects the water sensitive material, e.g., the cyclodextrin/perfume complex particles, so that they attach to fabrics; and then releases the water sensitive material, e.g., the complex in the dryer so that the complex can release perfume when the fabric is subsequently rewetted. The water sensitive material, e.g., particulate cyclodextrin/-perfume complex is typically imbedded in the protective material so that it is effectively "enrobed" or "surrounded" and the protective material effectively prevents water and/or other materials from destroying the complex and/or displacing the perfume. Other water sensitive materials can also be protected by the protective material.

It is surprising that the complex can be so effectively protected during storage and in such hostile environments as a liquid fabric softener composition, a laundry solution, and/or water in a laundry rinse cycle and still be readily released in the drying cycle. The protective material is preferably almost totally water-insoluble and, at most, only slightly swellable in water (non-water-swellable) to maximize protections. E.g., the solubility in water at room temperature is typically less than about 250 ppm, preferably less than about 100 ppm, more preferably less than about 25 ppm. Depending upon the solubility, chemical properties, and/or structures of any protective material (or composition), the solubility can readily be determined by known analytical methods, e.g., gravimetric, osmometric, spectrometric, and/or spectroscopic methods. The melting point (MP), or rarnge, of the protective material is between about 30° C. and about 90° C., preferably between about 35° C. and about 80° C., more preferably between about 40° and about 75° C. The melting point can be either sharp or the melting can occur gradually over a temperature range. It can be desirable to have a melting range, since the presence of some molten material early in the drying cycle helps to attach the particles to the fabric, thereby minimizing the loss of particles through the air outlet holes and the presence of higher melting materials helps protect the cyclodextrin/perfume complex during the early part of the drying cycle when there is still a substantial amount of moisture present.

Suitable protective materials are petroleum waxes, natural waxes, fatty materials such as fatty alcohol/fatty acid esters, polymerized hydrocarbons, etc. Suitable examples include the following: Vybar 260 (MP about 51° C.) and Vybar 103 (MP about 72° C.), polymerized hydrocarbons sold by Petrolite Corporation; myristyl (MP about 38°-40° C.), cetyl (MP about 51° C.), and/or stearyl (MP about 59°-60° C.) alcohols; hydrogenated tallow acid ester of hydrogenated tallow alcohol (MP about 55° C.); cetyl palmitate (MP about 50° C.); hydrogenated castor oil (MP about 87° C.); partially hydrogenated castor oil (MP about 70° C.); methyl 12-hydroxystearate (MP about 52° C.); ethylene glycol 12-hydroxystearate ester (MP about 66° C.); propylene glycol 12-hydroxy ester (MP about 53° C.); glycerol 12-hydroxystearate monoester (MP about 69° C); N-(betahydroxyethyl)ricinoleamide (MP about 46° C.); calcium ricinoleate (MP about 85° C.); alkylated polyvinyl pyrollidone (PVP) derivatives such as Ganex polymers V220 (MP about 35°-40° C.) and WP-660 (MP about 58°-68° C); silicone waxes such as stearyl methicones SF1134 from General Electric Co. (MP about 36° C.), and Abil Wax 9809 from Goldschmidt (MP about 38° C.); and mixtures thereof. Other suitable protective materials are disclosed in U.S. Pat. Nos.: 4,152,272, Yound, issued May 1, 1979 and 4,954,285, Wierenga et al., issued Sep. 4, 1990, both of said patents being incorporated herein by reference.

The protected particles described herein can also be used in solid, especially particulate, products. When the particles are stored in dry products and only exposed to aqueous media for short times, protective materials that are slowly water-swellable can be used to protect water sensitive materials for the short time they are exposed to the aqueous media.

The protected particulate complexes of cyclodextrin and perfume can be prepared by a variety of methods. The complex can surprisingly be mixed with the molten protective material without destroying the complex structure, cooled to form a solid, and the particle size reduced by a method that does not melt the said protective material, e.g., cryognic grinding; extrusion of fine ∓cylindrical" shapes followed by chopping; and/or mixtures thereof. Such methods tend to form desirable irregular particles that are easily entrapped in the fabrics during the rinse cycle of a typical home laundry operation using an automatic washer and/or when the rinse water is filtered through the fabrics at the end of the rinse cycle. The complexes can also be protected by spraying the molten protective material onto a fluidized bed of the complex particles or by spray cooling the molten protective material with the complex suspended in it. The process that is selected can be any of those known to the prior art, so long as the process results in substantially complete coverage of the complex particles.

A preferred process of forming protected particles using protective materials such as those herein, involves: (a) preparing a melt of the said material; (b) admixing the particle; (c) dispersing the molten mixture with high shear mixing into either an aqueous surfactant solution or an aqueous fabric softener composition: and then (d) cooling the resulting dispersion to solidify the protective material. If the protected particles are formed in an aqueous surfactant solution, they can be added as a performed dispersion to the fabric softener composition. They can also be dried and added in particulate form to particulate fabric softener compositions, detergent compositions, etc. In addition to the perfume/cyclodextrin complex particles, this preferred process can be used to protect other particles, including perfume particles made by coacervation techniques, e.g., as disclosed in U.S. Pat. No. 4,945,624, Michael, issued Aug. 7, 1990, said patent being incorporated herein by reference. Other, e.g., water sensitive and relatively water-insoluble particles or relatively water-insoluble particles that are incompatible with, e.g., fabric softener compositions can be protected by the same process. For example, bleach materials, bleach activators, etc., can be protected by this process.

When these particles are formed in an aqueous surfactant solution, it should contain at least about the critical michelle concentration of said surfactant. The particles resulting from dispersing the particles in the surfactant solution are especially desirable when they are dried and used in either granular detergent compositions or powdered fabric softener compositions.

The complex imbedded in protective material can be added as large particles into aqueous fabric softener composition and the resulting slurry subjecting to high shear mixing to reduce the particle size of the complex particles. This process is desirable, since the energy required to break up dry particles will tend to melt the encapsulating material and reagglomerate the particles unless the heat is removed and/or absorbed, e.g., by use of liquid nitrogen or solid carbon dioxide.

Typically, the amount of protective material is from about 50% to about 1000%, preferably from about 100% to about 500%, more preferably from about 150% to about 300%, of the cyclodextrin/perfume complex. In general, the least amount of the protective material that is used, the better. Hydrocarbon materials usually provide the best protection against an aqueous environment.

The encapsulated particles preferably range in diameter between about 1 and about 1000 microns, preferably between about 5 and about 500 microns, more preferably between about 5 and about 250 microns. Although some of the particles can be outside these ranges, most, e.g., more than about 90% by weight, of the particles should have diameters within the ranges. There is a balance between protection of the complex and the ability of the particles to be retained on the fabric. The larger particles protect the complex better during storage in the liquid fabric softener compositions and in the rinse water and can be retained on the fabric as a result of the filtration mechanism when the fabrics are "spun dry" at the end of the typical rinse cycle. However, small particles can be entrapped in the weave of the fabric during the rinse cycle and therefore tend to be more efficiently attached to the fabric. Thus, during the early part of the drying cycle, before the encapsulating material has softened, the larger particles are more easily dislodged by the tumbling action of the dryer. The smaller particles, i.e., those having diameters of less than about 250 microns and therefore more efficient overall in providing the desired end benefit.

The protected particles can also be used by admixing them with granular detergent compositions, e.g., those described in U.S. Pat. Nos.: 3,936,537, Baskerville, issued Feb. 3, 1976; 3,985,669, Krummel et al., issued Oct. 12, 1976; 4,132,680, Nicol, issued Jan. 2, 1979; etc., all of said patents being incorporated herein by reference.

6. THE FABRIC SOFTENERS

Fabric softeners that can be used herein are disclosed in U.S. Pat. Nos. 3,861,870, Edwards and Diehl; 4,308,151, Cambre; 3,886,075, Bernardino; 4,233,164, Davis: 4,401,578, Verbruggen; 3,974,076, Wiersema and Rieke; and 4,237,016, Rudkin, Clint, and Young, all of said patents being incorporated herein by reference.

A preferred fabric softener of the invention comprises the following:

Component I(a)

A preferred softening agent (active) of the present invention is the reaction products of higher fatty acids with a polyamine selected from the group consisting of hydroxyalkylalkylenediamines and dialkylenetriamines and mixtures thereof. These reaction products are mixtures of several compounds in view of the multifunctional structure of the polyamines (see, for example, the publication by H. W. Eckert in Fette-Seifen-Anstrichmittel, cited above).

The preferred Component I(a) is a nitrogenous compound selected from the group consisting of the reaction product mixtures of some selected components of the mixtures. More specifically, the preferred Component I(a) is compounds selected from the group consisting of:

(i) the reaction product of higher fatty acids with hydroxyalkylalkylenediamines in a molecular ratio of about 2:1, said reaction product containing a composition having a compound of the formula:

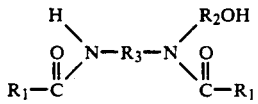

wherein $R_1$ is an acyclic aliphatic $C_{15}$–$C_{21}$ hydrocarbon group and $R_2$ and $R_3$ are divalent $C_1$–$C_3$ alkylene groups;

(ii) substituted imidazoline compounds having the formula:

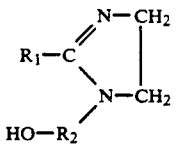

wherein $R_1$ and $R_2$ are defined as above;

(iii) substituted imidazoline compounds having the formula:

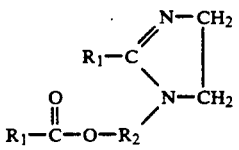

wherein $R_1$ and $R_2$ are defined as above;

(iv) the reaction product of higher fatty acids with dialkylenetriamines in a molecular ratio of about 2:1, said reaction product containing a composition having a compound of the formula:

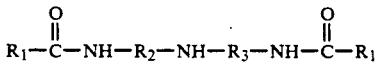

wherein $R_1$, $R_2$ and $R_3$ are defined as above; and (v) substituted imidazoline compounds having the formula:

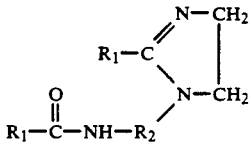

wherein $R_1$ and $R_2$ are defined as above;

and mixtures thereof.

Component I(a)(i( is commercially available as Mazamide® 6, sold by Mazer Chemicals, or Ceranine® HC, sold by Sandoz Colors & Chemicals; here the higher fatty acids are hydrogenated tallow fatty acids and the hydroxyalkylalkylenediamine in N-2-hydroxyethylethylenediamine, and $R_1$ is an aliphatic $C_{15}$–$C_{17}$ hydrocarbon group, and $R_2$ and $R_3$ are divalent ethylene groups.

An example of Component I(a)(ii) is stearic hydroxyethyl imidazoline wherein $R_1$ is an aliphatic $C_{17}$ hydrocarbon group, $R_2$ is a divalent ethylene group; this chemical is sold under the trade names of Alkazine® ST by Alkaril Chemicals, Inc., or Schercozoline® S by Scher Chemicals, Inc.

An example of Component I(a)(iv) is N,N''-ditallowalkoyldiethylenetriamine where $R_1$ is an aliphatic $C_{15}$–$C_{17}$ hydrocarbon group and $R_2$ and $R_3$ are divalent ethylene groups.

An example of Component I(a)(v) is 1-tallowamidoethyl-2-tallowimidazoline wherein $R_1$ is an aliphatic $C_{15}$–$C_{17}$ hydrocarbon group and $R_2$ is a divalent ethylene group.

The Components I(a)(iii) and I(a)(v) can also be first dispersed in a Bronstedt acid dispersing aid having a pKa value of not greater than about 4; provided that the pH of the final composition is not greater than about 5. Some preferred dispersing aids are hydrochloric acid, phosphoric acid, or methylsulfonic acid.

Both N,N''-ditallowalkoyldiethylenetriamine and 1-tallowethylamido-2-tallowimidazoline are reaction products of tallow fatty acids and deithylenetriamine, and are precursors of the cationic fabric softening agent methyl-1-tallowamidoethyl-2-tallowimidazolinium methylsulfate (see "Cationic Surface Active Agents as Fabric Softeners, " R. R. Egan, Journal of the American Oil Chemicals' Society, January 1978, pages 118–221). N,N''-ditallowalkoyldiethylenetriamine and 1-tallowamidoethyl-2-tallowimidazoline can be obtained from Sherex Chemical Company as experimental chemicals. Methyl-1-tallowamidoethyl-2-tallowimidazolinium methylsulfate is sold by Sherex Chemical Company under the trade name Varisoft® 475.

Component I(b)

The preferred Component I(b) is a cationic nitrogenous salt containing one long chain acyclic aliphatic $C_{15}$–$C_{22}$ hydrocarbon group selected from the group consisting of:

(i) acyclic quaternary ammonium salts having the formula:

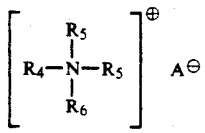

wherein $R_4$ is an acyclic aliphatic $C_{15}$–$C_{22}$ hydrocarbon group, $R_5$ and $R_6$ are $C_1$–$C_4$ saturated alkyl or hydroxyalkyl groups, and $A^{\ominus}$ is an anion;

(ii) substituted imidazolinium salts having the formula:

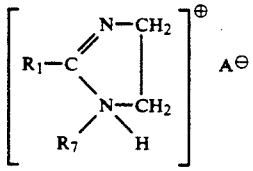

wherein $R_1$ is an acyclic aliphatic $C_{15}$–$C_{21}$ hydrocarbon group, $R_7$ is a hydrogen or a $C_1$–$C_4$ saturated alkyl or hydroxyalkyl group, and $A^0$ is an anion;

(iii) substituted imidazolinium salts having the formula:

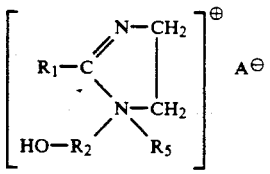

wherein $R_2$ is a divalent $C_1$–$C_3$ alkylene group and $R_1$, $R_5$ (iv) alkylpyridinium salts having the formula:

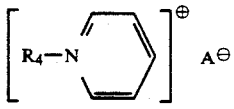

wherein $R_4$ is an acyclic aliphatic $C_{16}$–$C_{22}$ hydrocarbon group and $A^{\ominus}$ is an anion; and (v) alkanamide alkylene pyridinium salts having the formula:

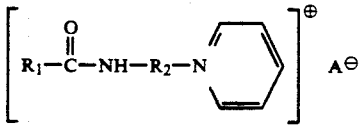

wherein $R_1$ is an acyclic aliphatic $C_{15}$–$C_{21}$ hydrocarbon group, $R_2$ is a divalent $C_1$–$C_3$ alkylene group, and $A^{\ominus}$ is an ion group;

and mixtures thereof.

Examples of Component I(b)(i) are the monoalkyltrimethylammonium salts such as monotallowtrimethylammonium chloride, mono(hydrogenated tallow)-trimethylammonium chloride, palmityltrimethylammonium chloride and soyatrimethylammonium chloride, sold by Sherex Chemical Company under the trade names Adogen ® 471, Adogen 441, Adogen 444, and Adogen 415, respectively, In these salts, $R_4$ is an acyclic aliphatic $C_{16}$–$C_{18}$ hydrocarbon group, and $R_6$ and $R_6$ are methyl groups. Mono(hydrogenated tallow)-trimethylammonium chloride and monotallowtrimethylammonium chloride are preferred. Other examples of Component I(b)(i) are behenyltrimethylammonium chloride wherein $R_4$ is a $C_{22}$ hydrocarbon group and sold under the trade name Kemamine ® Q2803-C by Humko Chemical Division of Witco Chemical Corporation; soyadimethylethylammonium ethosulfate wherein $R_4$ is a $C_{16}$–$C_{18}$ hydrocarbon group, $R_5$ is a methyl group, $R_6$ is an ethyl group, and A is an ethylsulfate anion, sold under the trade name Jordaquat ® 1033 by Jordan Chemical Company; and methyl-bis(2-hydroxyethyl)octadecylammonium chloride wherein $R_4$ is a $C_{18}$ hydrocarbon group, $R_5$ is a 2-hydroxyethyl group and $R_6$ is a methyl group and available under the trade name Ethoquad ® 18/13 from Armak Company.

An example of Component I(b)(iii) is 1-ethyl-1-(2-hydroxyethyl)-2-isoheptadecylimidazolinium ethylsulfate wherein $R_1$ is a $C_{17}$ hydrocarbon group, $R_2$ is an ethylene group, $R_5$ is an ethyl group, and A is an ethylsulfate anion. It is available from Mona Industries, Inc., under the trade name Monaquat ® ISIES.

Component I(c)

Preferred cationic nitrogenous salts having two or more long chain acylic aliphatic $C_{15}$–$C_{22}$ hydrocarbon groups or one said group and an arylalkyl group which can be used either alone or as part of a mixture are selected from the group consisting of:

(i) acyclic quaternary ammonium salts having the formula:

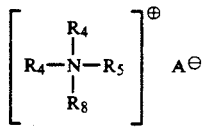

wherein $R_4$ is an acyclic aliphatic $C_{15}$–$C_{22}$ hydrocarbon group, $R_5$ is a $C_1$–$C_4$ saturated alkyl or hydroxyalkyl group, $R_8$ is selected from the group consisting of $R_4$ and $R_5$ groups, and $A^{\ominus}$ is an anion defined as above;

(ii) diamido quaternary ammonium salts having the formula:

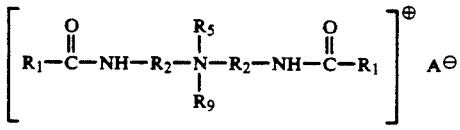

wherein $R_1$ is an acyclic aliphatic $C_{15}$–$C_{21}$ hydrocarbon group, $R_2$ is a divalent alkylene group having 1 to 3 carbon atoms, $R_5$ and $R_9$ are $C_1$–$C_4$ saturated alkyl or hydroxyalkyl groups, and $A^{\ominus}$ is an anion;

(iii) diamino alkoxylated quaternary ammonium salts having the formula:

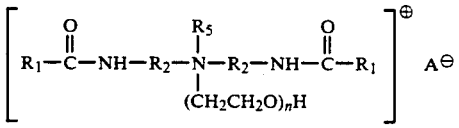

wherein n is equal to 1 to about 5, and $R_1$, $R_2$, $R_5$ and $A^{\ominus}$ are as defined above;

(iv) quaternary ammonium compounds having the formula:

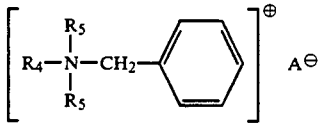

wherein $R_4$ is an acyclic aliphatic $C_{15}$–$C_{22}$ hydrocarbon group, $R_5$ is a $C_1$–$C_4$ saturated alkyl or hydroxyalkyl group, $A^{\ominus}$ is an anion;

substituted imidazolinium salts having the formula:

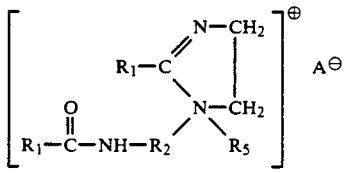

wherein $R_1$ is an acyclic aliphatic $C_{15}$–$C_{21}$ hydrocarbon group, $R_2$ is a divalent alkylene group having 1 to 3 carbon atoms, and $R_5$ and $A^{\ominus}$ are as defined above; and (vi) substituted imidazolinium salts having the formula:

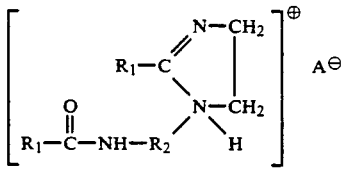

wherein $R_1$, $R_2$ and $A^{\ominus}$ are as defined above;

and mixtures thereof.

Examples of Component I(c)(i) are the well-known dialkyldimethylammonium salts such as ditallowdimethylammonium chloride, ditallowdimethylammonium methylsulfate, di(hydrogenated tallow)dimethylammonium chloride, distearyldimethylammonium chloride, dibehenyldimethylammonium chloride. Di(hydrogenated tallow)dimethylammonium chloride and ditallowdimethylammonium chloride are preferred. Examples of commercially available dialkldimethylammonium salts usable in the present invention are di(hydrogenated tallow)dimethylammonium chloride (trade name Adogen 442), ditallowdimethylammonium chloride (trade name Adogen 470), distearyldimethylammonium chloride (trade name Arosurf®°TA-100), all available from Sherex Chemical Company, Dibehenyldimethylammoinium chloride wherein $R_4$ is an acyclic aliphatic $C_{22}$ hydrocarbon group is sold under the trade name Kemamine Q-2802C by Humko Chemical Division of Witco Chemical Corporation.

Examples of Component I(c)(ii) are methylbis(tallowamidoethyl)(2-hydroxyethyl)ammonium methylsulfate and methylbis(hydrogenated tallowamidoethyl)(2-hydroxyethyl)ammonium methylsulfate wherein $R_1$ is a acyclic aliphatic $C_{15}$–$C_{17}$ hydrocarbon group, $R_2$ is an ethylene group, $R_5$ is a methyl gorup, $R_9$ is a hydroxyalkyl group and A is a methylsulfate anion; these materials are available from Sherex Chemical Company under the trade names Varisoft 222 and Varisoft 110, respectively.

An example of Component I(c)(iv) is dimethylstearylbenzylammonium chloride wherein $R_4$ is an acyclic aliphatic $C_{18}$ hydrocarbon group, $R_5$ is a methyl group and A is a chloride anion, and is sold under the trade names Varisoft SDC by Sherex Chemical Company and Ammonyx® 490 by Onyx Chemical Company.

Examples of Component I(c)(v) are 1-methyl-1-tallowamidoethyl-2-tallowimidazolinium methylsulfate and 1-methyl-1-(hydrogenated tallowamidoethyl)-2-(hydrogenated tallow)imidazolinium methylsulfate wherein $R_1$ is an acyclic aliphatic $C_{15}$–$C_{17}$ hydrocarbon group, $R_2$ is an ethylene group, $R_5$ is a methyl group and A is a chloride anion; they are sold under the trade names Varisoft 475 and Varisoft 445, respectively, by Sherex Chemical Company.

A preferred composition contains Component I(a) at a level of from about 10% to about 80%, Component I(b) at a level of from about 5% to about 40%, and Component I(c) at a level of from about 10% to about 80%, by weight of said Component I. A more preferred composition contains Component I(c) which is selected rom the group consisting of: (i) di(hydrogenated tallow)dimethylammonium chloride and (v) methyl-1-tallowamidoethyl-2-tallowimidazolinium methylsulfate; and mixtures thereof.

Component I is preferably present at from about 4% to about 27% by weight of the total composition. More specifically, this composition is more preferred wherein Component I(a) is the reaction product of about 2 moles of hydrogenated tallow fatty acids with about 1 mole of N-2-hydroxyethylethylenediamine and is present at a level of from about 20% to about 60% by weight of Component I; and wherein Component I(b) is mono(hydrogenated tallow)trimethylammonium chloride present at a level of from about 3% to about 30% by weight of Component I; and wherein Component I(c) is selected from the group consisting of di(hydrogenated tallow)dimethylammonium chloride, ditallowdimethylammonium chloride and methyl-1-tallowamidoethyl-2-tallowimidazolinium methylsulfate, and mixtures thereof; said Component I(c) is present at a level of from about 20% to about 60% by weight of Component I; and wherein the weight ratio of said di(hydrogenated tallow)dimethylammonium chloride to said methyl-1-tallowamidoethyl-2-tallowimidazolinium methylsulfate is from about 2:1 to about 6:1.

The above individual components can also be used individually, especially those of I(c).

Anion A

In the cationic nitrogensous salts hereuin, the anion $A^{\ominus}$ provides charge neutrality. Most often, the anion used to provide charge neutrality in these salts is a halide, such as fluoride, chloride, bromide, or iodide, However, other anions can be used, such as methylsulfate, ethylsulfate, hydroxide, acetate, formate, sulfate, carbonate, and the like. Chloride and methylsultage are preferred herein as anion A.

7. LIQUID CARRIER

The liquid carrier is selected from the group consisting of water, $C_1$–$C_4$ monohydric alcohols, $C_2$–$C_6$ polyhydric alcohols (e.g., alkylene glycols like propylene glycol), liquid polyalkylene glycols such as polyethylene glycol with an average molecular weight of about 200, and mixtures thereof. The water which is used can be distilled, deionized, or tap water.

8. OPTIONAL POLYMERIC SOIL RELEASE AGENTS

Soil release agents, usually polymers, are especially desirable additives at levels of from about 0.05% to about 5%. Suitable soil release agents are disclosed in U.S. Pat. Nos.: 4,702,857, Gosselink, issued Oct. 27, 1987; 4,711,730, Gosselink and Diehl, issued Dec. 8, 1987; 4,713,194, Gosselink issued Dec. 15, 1987; 4,877,896, Maldonado, Trinh, and Gosselink, issued Oct. 31, 1989; 4,956,447, Gosselink, Hardy, and Trinh, issued Sep. 11, 1990; and 4,749,596, Evans, Huntington, Stewart, Wolf, and Zimmerer, issued Jun. 7, 1988, said patents being incorporated herein by reference. It is a special advantage of the soil release polymers, that they improve the suspension stability of particles in the liquid fabric softener compositions, i.e., the particles remain stably suspended in the liquid compositions without excessive separation occurring. The soil release agent usually does not substantially increase viscosity. This result was totally unexpected. However, it allows the preparation of the stable fabric softener compositions within the additional benefit of improved soil release in the next wash without having to incur the expense and formulation difficulties that accompany the addition of a material solely for the purpose of stably suspending the particles.

A special advantage of using a soil release polymer to suspend the protected particles herein, is the minimization of buildup on fabrics from the protective material. Without the solid release polymer the protective material, especially hydrocarbon, tend to deposit on, and build up from extended use, especially on synthetic fabrics (e.g., polyesters).

Especially desirable optional ingredients are polymeric soil release agents comprising block copolymers of polyalkylene terephthalate and polyoxyethylene terephthalate, and block polymers of polyalkylene terephthalate and polyethylene glycol. The polyalkylene terephthalate blocks preferably comprise ethylene and/or propylene alkylene groups. Many of such soil release polymers are nonionic.

A preferred nonionic soil release polymer has the following average structure:

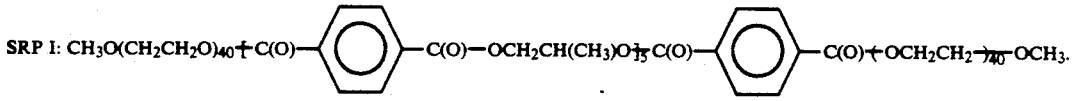

Such soil release polymers are described in U.S. Pat. No. 4,849,257, Borcher, Trinh and Bolich, issued Jul. 18, 1989, said patent being incorporated herein by reference.

Another highly preferred nonionic soil release polymer is described in copending U.S. Pat. application Ser. No. 07/676,682, filed Mar. 28, 1991, by Pan, Gosselink, and Honsa, for Nonionic Soil Release Agents, said application being incorporated herein by reference.

The polymeric soil release agents useful in the present invention can include anionic and cationic polymeric soil release agents. Suitable anionic polymeric or oligomeric soil release agents are disclosed in U.S. Pat. No. 4,018,569, Trinh, Gosselink and Rattinger, issued Apr. 4, 1989, said patent being incorporated herein by reference. Other suitable polymers are disclosed in U.S. Pat. No. 4,808,086, Evans, Huntington, Stewart, Wolf, and Zimmerer, issued Feb. 24, 1989 said patent being incorporated herein by reference. Suitable cationic soil release polymers are described in U.S. Pat. No. 4,956,447, Gosselink, Hardy, and Trinh, issued Sep. 11, 1990, said patent being incorporated hereinbefore by reference.

The level of soil release polymer, when it is present, typically is from about b 0.05% to about 5%, preferably from about 0.1% to about 4%, more preferably from about 0.2% to about 3%.

9. OTHER OPTIONAL INGREDIENTS

A preferred optional ingredient is free perfume, other than the perfume which is present as the perfume/cyclodextrin complex, which is also very useful for imparting odor benefits, especially in the product and/or in the rinse cycle and/or in the dryer. Preferably, such uncomplexed perfume contains at least about 1%, more preferably at least about 10% by weight of said uncomplexed perfume, of substantive perfume materials. Such uncomplexed perfume is preferably present at a level of from about 0.01% to about 5%, preferably from about 0.05% to about 2%, more preferably from about 0.1% to about 1%, by weight of the total composition.

Other adjuvants can be added to the compositions herein for their known purposes. Such adjuvants include, but are not limited to, viscosity control agents, uncomplexed perfumes, emulsifiers, preservatives, antioxidants, bacteriocides, fungicides, brighteners, opacifiers, freeze-thaw control agents, shrinkage control agents, and agents to provide ease of ironing. These adjuvants, if used, are added at their usual levels, generally each of up to about 5% by weight of the composition.

Viscosity control agents can be organic or inorganic in nature. Examples of organic viscosity modifiers (lowering) are aryl carboxylates and sulfonates (e.g., benzoate, 2-hydroxybenzoate, 2-aminobenzoate, benzenesulfonate, 2-hydroxybenzenesulfonate, 2-aminobenzenesulfonate, etc.), fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 6,000 parts per million (ppm), preferably from about 20 to about 4,000 ppm by weight of the composition.

Viscosity modifiers (raising) can be added to increase the ability of the compositions to stably suspend particles, e.g., the protected particles or other water-insoluble particles. Such materials include hydroxypropyl substituted guar gum (e.g., Jaguar HP200, available from Rhone-Poulenc), cationic modified acrylamide (e.g., Floxan EC-2000, available from Henkel Corp.), polethylene glycol (e.g., Carbowax 20M from Union Carbide), hydrophobic modified hydroxyethylcellulose (e.g., Natrosol Plus from Aqualon), and/or organophilic clays (e.g., Hectorite and/or Bentonite clays such as Bentones 27, 34 and 38 from Rheox Co.). These viscosity raisers (thickeners) are typically used at levels from about 500 ppm to about 30,000 ppm, preferably from about 1,000 ppm to about 5,000 ppm, more preferably from about 1,500 ppm to about 3,500 ppm.

Examples of bacteriocides used in the compositions of this invention are glutaraldehyde, formaldehyde, 2-bromo-2-nitropropane-1,3-diol sold by Inolex Chemicals under the trade name Bronopol ®, and a mixture of 5-chloro-2-methyl-4-isothiazolin-3-one and 2-methyl-4-isothiazoline-3-one sold by Rohm and Haas Company under the tradename Kathon ® CG/ICP. Typical levels of bacteriocides used in the present compositions are from about 1 to about 1,000 ppm by weight of the composition.

Examples of antioxidants that can be added to the compositions of this invention are propyl gallate, available from Eastman Chemical Products, Inc., under the trade names Tenox ® PG and Tenox S-1, and butylated hydroxy toluene, available from UOP Process Division under the trade name Sustane ® BHT.

The present compositions can contain silicones to provide additional benefits such as ease of ironing and improved fabric feel. The preferred silicones are polydimethylsiloxanes of viscosity of from about 100 centistokes (cs) to about 100,000 cs, preferably from about 200 cs to about 60,000 cs and/or silicone gums. These silicones can be used in emulsified form, which can be conveniently obtained directly from the supplies. Examples of these preemulsified silicones are 60% emulsion of polydimethylsiloxane (350 cs) sold by Dow Corning Corporation under the trade name DOW CORNING ® 1157 Fluid and 50% emulsion of polydimethylsiloxane (10,000 cs) sold by General Electric Company under the trade name General Electric ® SM 2140 Silicones. Microemulsions are preferred, especially when the composition contains a dye. The optional silicone component can be used in an amount of from about 0.1% to about 6% by weight of the composition.

Silicone foam suppressants can also be used. These are usually not emulsified and typically have viscosities of from about 100 cs to about 10,000 cs, preferably from about 200 cs to about 5,000 cs. Very low levels are used, typically rom about 0.01% to about 1%, preferably from about 0.02% to about 0.5%. Another preferred foam suppressant is a silicone/silicate mixture, e.g., Dow Corning's Antifoam A.

A preferred composition contains from 0% to about 3% of polydimethylsiloxane, from 0% to about 0.4% of $CaCl_2$, and from about 10 ppm to about 100 ppm of dye.

The pH (10% solution) of the compositions of this invention is generally adjusted to be in the range of from about 2 to about 7, preferably from about 2.4 to about 6.5, more preferably from about 2.6 to about 4. Adjustment of pH is normally carried out by including a small quantity of free acid in the formulation. Because no strong pH buffers are presently, only small amounts of acid are required. Any acidic material can be used; its selection can be made by anyone skilled in the softener arts on the basis of cost, availability, safety, etc. Among the acids that can be used are methyl sulfonic, hydrochloric, sulfuric phosphoric, citric, maleic, and succinic. For the purposes of this invention, pH is measured by a glass electrode in a 10% solution in water of the softening composition in comparison with a standard calomel reference electrode.

The liquid fabric softening compositions of the present invention can be prepared by conventional methods. A convenient and satisfactory method is to prepare the softening active premix at about 72°-77° C., which is then added with stirring to the hot water seat. Temperature-sensitive optional components can be added water the fabric softening composition is cooled to a lower temperature.

The liquid fabric softening compositions of this invention are used by adding to the rinse cycle of conventional home laundry operations. Generally, rinse water has a temperature of from about 5° C. to about 50° C., more frequently from about 10° C. to about 40° C. The concentration of the fabric softener actives of this invention is generally from about 10 ppm to about 200 ppm, preferably from about 25 ppm to about 100 ppm, by weight of the aqueous rinsing bath. The cyclodextrin/perfume complex is at a concentration of from about 5 ppm to about 200 ppm, preferably from about 10 ppm to about 150 ppm, more preferably from about 10 ppm to about 50 ppm.

In general, the present invention in its fabric softening method aspect comprises the steps of (1) washing fabrics in a conventional washing machine with a detergent composition; and (2) rinsing the fabrics in a bath which contains the above described amounts of the fabric softeners and protected cyclodextrin/perfume complex particles; and (3) drying the fabrics in an automatic laundry dryer. When multiple rinses are used, the fabric softening composition is preferably added to the final rinse.

10. COMPOSITIONAL ADVANTAGES OF THE PRESENT INVENTION

As discussed hereinbefore, the ability to have a product with low product perfume odor and an acceptable initial fabric perfume odor, but also have a long-lasting fabric perfume odor has been the goal of many development projects for consumer laundry products. the products of this invention preferably only contain enough free perfume to deliver both an acceptably low "product perfume odor" and an acceptable "initial fabric perfume odor." Perfume incorporated into the product in the form of protected particles containing perfume complexed with cyclodextrin (CD), will be released primarily when the fabric is used in situations where renewed perfume odor is really and appropriately needed, e.g., when some moisture is present, such as when using wash cloths and towels in a bathroom, or when there is perspiration odor on clothes during and after a high level of physical activity.

The products of this invention can contain only the protected perfume/CD complex, without any noticeable amount of free perfume. In this case, the products initially appear to be unscented products. Fabrics treated with these products do not carry any obvious perfume odor that can "clash" with other expensive personal fragrances that the consumer may wish to wear. Only when extra perfume is needed, such as for bathroom use, of for perspiration, is the perfume in the complex released.

During storage of the treated fabrics, a small amount of perfume can escape from the complex as a result of the quilibrium between the perfume/CD complex and free perfume and CD, and a light scent is obtained. If the product contains both free and complexed perfume, this escaped perfume from the complex contributes to the overall fabric perfume odor intensity, giving rise to a longer lasting fabric perfume odor impression. Thus, by adjusting the levels of free perfume and perfume/CD complex it is possible to provide a wide range of unique perfume profiles in terms of timing and/or perfume identity and character.

The protected perfume/cyclodextrin complex particles are usually incorporated into the liquid, rinse-added, fabric conditioning compositions. Therefore, the invention also encompasses a process (method) for imparting long-lasting perfume benefits plus softening and/or antistatic effects to fabrics in an automatic laundry washer/dryer processing cycle comprising: washing said fabrics; rinsing said fabrics with an effective, i.e., softening, amount of a composition comprising softening active(s) and an effective amount of protected perfume/CD particles; and tumbling said fabrics under heat in said dryer with said protected perfume/CD complex particles to effectively release said perfume/CD complex particles.

This invention also contributes to the aesthetics of the clothes washing process. One important point in the laundry process where the consumer appreciates the odor (fragrance) is during the wash process (i.e., from the wash water and during the transfer of wet clothes to the dryer). This aesthetic benefit is currently provided mainly by the perfume added via the detergent composition or liquid softener composition to the wash and/or rinse water. Clothes that have been pretreated, e.g., in the previous rinse with the methods of this invention and machine dried, give off a burst of fragrance in the wash water, and the resulting fabrics are "perfumy" even though no other perfume is used in the washing, rinsing and/or drying steps.

11. OTHER COMPOSITIONS

In additional to the liquid fabric softener compositions described hereinbefore, the protected particles, especially protected cyclodextrin/perfume complex particles, can be added to solid particulate softener compositions and detergent compositions.

(a) Solid, Particulate Detergent Compositions

In detergent compositions, the amount of protective material should be higher, e.g., at least about 100% of the water sensitive material.

The protected particles, especially those containing perfume/cyclodextrin complexes can be formulated into granular detergent compositions by simple admixing. Such detergent compositions typically comprise detersive surfactants and detergency builders and, optionally, additional ingredients such as bleaches, enzymes, fabric brighteners and the like. The particles are present in the detergent composition at a level sufficient to provide from about 0.5% to about 30%, and preferably from about 1% to about 5% of cyclodextrin/perfume complex in the detergent composition. The remainder of the detergent composition will comprise from about 1% to about 50%, preferably from about 10% to about 25% detersive surfactant, and from about 10% to about 70%, preferably from about 20% to about 50% of a detergency builder, and, if desired, other optional laundry detergent components.

(i) The Surfactant

Surfactants useful in the detergent compositions herein include well-known synthetic anionic, nonionic, amphoteric and zwitterionic surfactants. Typical of these are the alkyl benzene sulfonates, alkyl and alkylether sulfates, paraffin sulfonates, olefin sulfonates, alkoxylated (especially ethoxylated) alcohols and alkyl phenols, amine oxides, alpha-sulfonates of fatty acids and of fatty acid esters, alkyl betaines, and the like, which are well known from the detergency art. In general, such detersive surfactants contain an alkyl group in the $C_9$–$C_{18}$ range. The anionic detersive surfactants can be used in the form of their sodium, potassium or triethanolammonium salts; the nonionics generally contain from about 5 to about 17 ethylene oxide groups. $C_{11}$–$C_{16}$ alkyl benzene sulfonates, $C_{12}$–$C_{18}$ paraffin-sulfonates and alkyl sulfates are especially preferred in the compositions of the present type.

A detailed listing of suitable surfactants for the detergent compositions herein can be found in U.S. Pat. No. 3,936,537, Baskerville, issued Feb. 3, 1976, incorporated by reference herein. Commercial sources of such surfactants can be found in McCutcheon's EMULSIFIERS AND DETERGENTS, North American Edition, 1987, McCutcheon Division, MC Publishing Company, also incorporated herein be reference.

(ii) Detergency Builders

Useful detergency builders for the detergent compositions herein include any of the conventional inorganic and organic water-soluble builder salts, as well as various water-insoluble and so-called "seeded" builders.

Nonlimiting examples of suitable water-soluble, inorganic alkaline detergent builder salts include the alkali metal carbonates, borates, phosphates, polyphosphates, tripolyphosphates, bicarbonates, silixcates, and sulfates. Specific examples of such salts include the sodium and potassium tetraborates, bicarbonates, carbonates, tripolyphosphates, pyrophosphates, and hexametaphosphates.

Examples of suitable water-soluble organic alkaline detergency builder salts are: (1) water-soluble amino polyacetates, e.g., sodium and potassium ethylenediaminetetraacetates, nitrilotriacetates, and N-(2-hydroxyethyl)nitrilodiacetates; (2) water-soluble salts of phytic acid, e.g., sodium and potassium phytates; (3) water-soluble polyphosphonates, including sodium, potassium and lithium salts of ethane-1-hydroxy-1,1-diphosphonic acid, sodium, potassium, and lithium salts of methylenediphosphonic acid and the like.

"Insoluble" builders include both seeded builders such as sodium carbonate or sodium silicate, seeded with calcium carbonate or barium sulfate; and hydrated sodium Zeolite A having a particle size of less than about 5 microns.

A detailed listing of suitable detergency builders can be found in U.S. Pat. No. 3,936,537, supra, incorporated herein by reference.

(iii) Optional Detergent Ingredients

Optional detergent composition components include enzymes (e.g., proteases and amylases), halogen bleaches (e.g., sodium and diperoxydodecane-1,12-dioic acid), inorganic percompound bleaches (e.g., sodium perborate), activators for perborate (e.g., etraacetylethylenediamine and sodium nonanoyloxybenzene sulfonate), soil release agents (e.g., methylcellulose, and/or nonionic polyester soil release polymers, and/or anionic polyester-soil release polymers, especially the anionic polyester soil release polymers disclosed in U.S. Pat. No. 4,877,896, Maldonado, Trinh, and Gosselink, issued Oct. 31, 1989, said patent being incorporated herein by reference), soil suspending agents (e.g., sodium carboxymethylcellulose) and fabric brighteners.

(b) Solid, Particulate Fabric Softener Compositions

Particulate fabric softener compositions for addition in the wash or rinse cycles of an automatic laundering operation have been described in, e.g., U.S. Pat. Nos.: 3,256,180, Weiss, issued Jun. 14, 1966; 3,351,483, Miner et al., issued Nov,. 7, 1967; 4,308,141, Cambre, issued Dec. 29, 1981; 4,589,989, Muller et al., issued May 20, 1986; and 5,009,800, Foster, issued Apr. 23, 1991; and foreign patent applications: Jap. Laid Open Appln. No. 8799/84, laid open Jan. 18, 1984; Jap, Appln, No. J62263698-A, Nov. 5, 1987; Jap. Laid Open Appln. No. 1-213476, laid open Aug. 28, 1989; Can. Appln. No. CA1232819-A, Feb. 16, 1988; Jap. Appln. No. J63138000-A, Jun. 9, 1988; and European Appln. No. EP-289313-A, Nov. 2, 1988, all of said patents and applications being incorporated herein by reference. A granular fabric softener composition which can be used to prepare a liquid composition is disclosed in U.S. patent application Ser. No. 07/689,406, Harman, Brown, Rusche and Taylor, filed Apr. 22, 1991, said application being incorporated herein by reference.

The fabric softener is typically present at a level of from about 20% to about 90%, preferably from about 30% to about 70%, in such particulate fabric softener compositions. The cyclodextrin/perfume complex, as the protected particles, is used at a level of from about 5% to about 80%, preferably from about 10% to about 70%, in such particulate fabric softener compositions. Whjen the particulate softener is to be added in the rinse cycle, water-swellable protective material can be used. When the composition is to be added in the wash cycle or formed into an aqueous composition, the protective material is preferably non-water-swellable and is used at higher levels.

All percentages, ratios, and parts herein are by weight unless otherwise stated.

The following are nonlimiting examples of the instant articles and methods.

Three different perfumes used in the following Examples are as follows:

Complete Perfume (A)

Perfume A is a substantive perfume which is composed mainly of moderate and nonvolatile perfume ingredients. The major ingredients of Perfume A are benzyl salicylate, para-tertiarybutyl cyclohexyl acetate, para-tertiary-butyl-alpha-methyl-hydrocinnamic aldehyde, citronellol, coumarin, galaxolide, heliotropine, hexyl cinnamic aldehyde, 4-(4-hydroxy-4-methyl pentyl)-3-cyclhexene-10-carboxaldehyde, methyl cedrylone, gamma-methyl ionone, and patchouli alcohol.

Perfume (B) (More Volatile Portion of Perfume A)

Perfume B is a rather nonsubstantive perfume which is composed mainly of highly and moderately volatile fractions of Perfume A. The major ingredients of Perfume B are linalool, alpha terpineol, citronellol, linalyl acetate, eugenol, flor acetate, benzyl acetate, amyl salicylate, phenylethyl alcohol and aurantiol.

Complete Perfume (C)

Perfume C is an essential oil added "free," without any protection or encapsulation, that provides fragrance to rinse added fabric softeners and odor-on-fabric benefits to fabrics treated with said softeners. It contains both substantive and non-substantive perfume ingredients.

The above-defined perfumes and others, as defined hereinafter, are used to form the following complexes, which are used in the Examples herein.

Complex 1 Perfume B/β-CD

A mobile slurry is prepared by mixing about 1 kg g of β-CD and 1,000 ml of water in a stainless steel mixing bowl of a KitchenAid mixer using a plastic coated heavy-duty mixing blade. Mixing is continued while about 176 g of Perfume B is slowly added. The liquid-like slurry immediately starts to thicken and becomes a creamy paste. Stirring is continued for 25 minutes. The paste is now dough-like in appearance. About 500 ml of water is added to the paste and blended well. Stirring is then resumed for an additional 25 minutes. During this time the complex again thickens, although not to the same degree as before the additional water is added. The resulting creay complex is spread in a thin layer on a tray and allowed to air dry. This produces about 1100 g of granular solid which is ground to a fine powder. The complex retains some free perfume and still has a residual perfume odor.

Complex 2

The remaining water in Complex 1 is removed by freeze drying, after which Complex 1 loses about 1% of its weight.

The relatively nonsubstantive Perfume B is surprisingly effective when incorporated in the fabric conditioning compositions and products described hereinafter.

Complex 3

Complex 3 is prepared like Complex 1 with Perfume C replacing Perfume B.

Protected Complex Particles 1

About 200 g of Vybar 260 polyolefin wax obtained from Petrolite Corp. is melted at about 60° C. About 100 g of Complex 1 is blended with the molten Vybar 260 wax, using a Silverson L4R high shear mixer. The well blended mixture is transferred to a tray, allowed to solidify, and coarsely divided. The Vybar 260/ complex solid mixture is cryogenically ground into small particles using liquid nitrogen. About 300 ml of liquid nitrogen is placed in a Waring Commercial Blender Model 31BL91 having a 1,000-ml stainless steel blender jar with a stainless steel screw cover. When the effervescence of the nitrogen subsides, about 25 g of the coarsely divided Vybar 260/complex solid mixture is added to the jar and ground for about 20 to 30 seconds. The remainder of the Vybar 260/complex solid mixture is ground in the same manner. The ground material is screened through sieves to obtain about 236 g of Vybar 260-Protected (cyclodextrin/Perfume) Complex Particles 1 of a size equal or smaller than about 250 microns in diameter.

Protected Complex Particles 2

The Vybar 260-Protected (Cyclodextrin/Perfume) Complex Particles 2 are made similarly to Protected Complex Particles 1, but Complex 1 is replaced by Complex 2.

Protected Complex Particles 3

The Vybar 103-Protected (cyclodextrin/Perfume) Complex Particles 3 are made similarly to Protected Complex Particles 2, but the Vybar 260 wax is replaced by Vybar 103 polyolefin was (obtained from Petrolite Corp.), which melts at about 90° C.

Protected Complex Particles 4

The protected particles are prepared by dispersing about 50 g of cyclodextrin/perfume Complex 3 in about 100 g of molten Vybar 260 with high shear mixing at about 70° C. About 45 g of this molten blend is then dispersed in about 600 g of an aqueous fabric softener composition with high shear mixing. Mixing is continued for sufficient time to assue good formation of Protected Complex Particles 4, followed by cooling to room temperature with stirring. The Protected Complex Particle 4 is a smooth, spherical, small particle (diameter about 30 microns) suspended in an aqueous fabric softener composition (Example 12, as disclosed hereinafter). Particle size can be varied by the extent-/duration of high shear mixing before cooling.

Examples of Liquid Fabric Conditioning Compositions

Nonlimiting Examples and Comparative Examples of liquid fabric conditioning compositions are given below to illustrate the advantage of the present invention.

| Components | Example 1 (Wt. %) | Example 2 (Wt. %) | Comparative Example 3 (Wt. %) |
|---|---|---|---|
| Ditallowdimethyl Ammonium Chloride (DTDMAC) (a) | 4.50 | 4.50 | 4.50 |
| Perfume A | — | 0.35 | 0.35 |
| Protected Complex Particles 2 | 6.00 | 6.00 | — |
| Minor Ingredients (b) | 0.20 | 0.20 | 0.20 |
| Deionized Water | Balance | Balance | Balance |
| | 100.00 | 100.00 | 100.00 |

(a) DTDMAC - ~83% = about 9.6%/68.7%/5.3% - mono-/di-/tritallowalkyl ammonium chloride in water/alcohol solvent. As used hereinafter, DTDMAC has this composition.
(b) Includes polydimethylsiloxane emulsion containing 55 wt. % of a polydimethylsiloxane having a viscosity of about 350 centistokes, and antifoam agent.

EXAMPLE 1

The composition of Example 1 is made by adding molten DTDMAC (at least 75° C.) with high shear mixing to a mixing vessel containing deionized water and antifoaming agent, heated to about 45° C. When the mixture has been thoroughly mixed, the polydimethylsiloxane emulsion is added and allowed to cool to room temperature. Protected Complex Particles 2 are then added with mixing.

EXAMPLE 2

The composition of Example 2 is made similary to that of Example 1, except that after the addition of the polydimethylsiloxane emulsion, the mixture is cooled to about 40° C., the free Perfume A is blended in, and the mixture is cooled further to room temperature before Protected Complex Particles 2 are added with mixing.

COMPARATIVE EXAMPLE 3

The composition of Comparative Example 3 is made similarly to that of Example 2, except that no Protected Complex Particles 2 are incorporated.

| Components | Example 4 (Wt. %) | Example 5 (Wt. %) |
|---|---|---|
| DTDMAC | 4.82 | 4.82 |
| 1-Tallowamidoethyl-2-tallow Imidazoline | 2.00 | 2.00 |
| Monotallowalkyltrimethyl-ammonium Chloride (MTTMAC) Solution (46%) | 0.67 | 0.67 |
| Lytron 621 (40%) | 0.75 | 0.75 |
| Soil Release Polymer (SRP I) (b) | — | 0.75 |
| Perfume A | 0.35 | 0.35 |
| Protected Complex Particles 1 | 11.00 | 11.00 |
| Minor Ingredients (a) | 0.20 | 0.28 |
| Hydrochloric Acid | to pH 2.8 | to pH 2.8 |
| Deionized Water | Balance | Balance |
| | 100.00 | 100.00 |

(a) As in Example 1.
(b) Structure given hereinbefore.

EXAMPLE 4

The composition of Example 4 is made by first melting and mixing 1-tallowamidoethyl-2-tallow imiadazoline, molten at about 85° C., to a mixture of DTDMAC and MTTMAC, molten at about 75° C., in a premix vessel. This premix is then added with high shear mixing to a mix vessel containing deionized water, Lytron 621 opacifying agent, antifoaming agent and $CaCl_2$, heated to about 70° C. A small amount of concentrated HCl is also added to adjust the pH of the composition to about 2.8—3.0. When the mixture is thoroughly mixed, the polydimethylsiloxane emulsion is added and allowed to cool to about 40° C. where free Perfume A is added with mixing. The mixture is allowed to cool further to room temperature, then Protected Complex Particles 1 are added with mixing.

EXAMPLE 5

The composition of Example 5 is made similarly to that of Example 4, except that the water phase also contains the soil release polymer, SRP I, and extra foam suppressing agent (about 0.08% of polydimethylsiloxane of about 500 cs) is added as the final step.

| Components | Example 6 (Wt. %) | Comparative Example 7 (Wt. %) |
|---|---|---|
| DTDMAC | 4.82 | 4.82 |
| 1-Tallowamidoethyl-2-tallow Imidazoline | 2.00 | 2.00 |
| MTTMAC Solution (46%) | 0.67 | 0.67 |
| Lytron 621 (40%) | 0.75 | 0.75 |
| SRP I | 0.75 | 0.75 |
| Perfume A | 0.35 | 0.35 |

-continued

| Components | Example 6 (Wt. %) | Comparative Example 7 (Wt. %) |
|---|---|---|
| Protected Complex Particles 3 | 11.00 | — |
| Minor Ingredients (a) | 0.20 | 0.20 |
| Hydrochloric Acid | to pH 2.8 | to pH 2.8 |
| Deionized Water | Balance | Balance |
| | 100.00 | 100.00 |

(a) As in Example 4.

EXAMPLE 6

The composition of Example 6 is made similarly to that of Example 5, except that Protected Complex Particles 1 are replaced by Protected Complex Particles 3.

COMPARATIVE EXAMPLE 7

The composition of Comparitive Example 7 is made similary to that of Example 6, except that no Protected Complex Particles are incorporated.

| Components | Example 8 (Wt. %) |
|---|---|
| DTDMAC | 47.20 |
| Polyethylene Glycol 200 | 23.60 |
| Ethanol | 7.08 |
| Protected Complex Particles 2 | 22.12 |
| | 100.00 |

EXAMPLE 8

The composition of Example 8 has a nonaqueous liquid carrier. Polyethylene glycol of average molecular weight of about 200 and DTDMAC are melted and thoroughly mixed together at about 70° C., then the mixture is allowed to cool to room temperature. Ethanol is then added with thorough mixing. Finally, Protected Complex Particles 2 are added with mixing.

| Components | Example 9 (Wt. %) | Example 10 (Wt. %) | Example 11 (Wt. %) |
|---|---|---|---|
| DTDMAC | 14.46 | 14.46 | 14.46 |
| 1-Tallowamidoethyl-2-tallow Imidazoline | 6.00 | 6.00 | 6.00 |
| Lytron 621 (40%) | 0.75 | 0.75 | 0.75 |
| SRP I | — | 2.25 | 2.25 |
| Perfume A | 1.05 | 1.05 | — |
| Protected Complex Particles 1 | 33.00 | 33.00 | 4.40 |
| Minor Ingredients (a) | 0.58 | 0.58 | 0.58 |
| Hydrochloric Acid | to pH 2.8 | to pH 2.8 | to pH 2.8 |
| Deionized Water | Balance | Balance | Balance |
| | 100.00 | 100.00 | 100.00 |

(a) As in Example 4.

EXAMPLE 9

The composition of Example 9 is made similarly to that of Example 4, except that most active ingredients are used at higher levels to obtain a concentrated composition.

EXAMPLE 10

The composition of Example 10 is made similarly to that of Example 5, except that most active ingredients are used at higher levels to obtain a concentrated composition.

EXAMPLE 11

The composition of Example 11 is made similarly to that of Example 10, except that most active ingredients are used at higher levels to obtain a concentrated composition.

FABRIC TREATMENT

Each laundry load is washed in a washer with the commercially available unscented TIDE® detergent. An appropriate amount (see Table) of each fabric conditioning composition is added to the rinse cycle. The wet laundry load is transferred and dried in an electric tumble dryer. The resulrting dried fabric is smelled, then rewetted by spraying with a mist of water and smelled agin to see whether more perfume is released. The results are given in the Table.

| Composition | Amount Used per Treatment (g) | Perfume Released Upon Rewetting |
|---|---|---|
| Example 1 | about 68 g | Yes |
| Example 2 | about 68 g | Yes |
| Comparative Example 3 | about 68 g | No |
| Example 4 | about 68 g | Yes |
| Example 5 | about 68 g | Yes |
| Example 6 | about 68 g | Yes |
| Comparative Example 7 | about 68 g | No |
| Example 8 | about 34 g | Yes |
| Example 9 | about 30 g | Yes |
| Example 10 | about 30 g | Yes |
| Example 11 | about 30 g | Yes |
| Example 12 | about 68 g | Yes |
| Comparative Example 13 | about 68 g | No |

PRODUCT STABILITY

When the compositions that contain the Protected Complex Particles are stored overnight, those that contain soil release polymer (5, 6, 10 and 11) are stable with most of the particles remaining substantially uniformly dispersed in the liquid phase, while those not containing soil release polymer (1, 2, 4, and 9) have Protected Complex Particles settling down to the bottom of the container.

EXAMPLE 12

The composition of Example 12 is made by first melting and mixing 1-tallowamidoethyl-2-tallow imidazoline (DTI), molten at about 85° C., to a mixture of DTDMAC and MTTMAC, molten at about 75° C., in a premix vessel. This premix is then added with high shear mixing to a mix vessel containing deionized water, at about 70° C., antifoaming agent and a small amount of concentrated HCl to adjust the pH of the composition to about 2.8–3.0. When the mixture is thoroughly mixed, the polydimethylsiloxane emulsion, Kathod CG preservative, and $CaCl_2$ are added; and the mixture is allowed to cool to about 60° C. A molten premix of Complex 3 and Vybar 260, at about 70° C., is aded with high shear mixing. The size of Protected Complex Particles 4 is varied by the extent and duration of high shear mixing. The mixture is allowed to cool further to room temperature, while stirring.

COMPARATIVE EXAMPLE 13

The composition of Example 13 is made by first melting and mixing 1-tallowamidoethyl-2-tallow imidazoline (TTI), molten at about 85° C., to a mixture of DTDMAC and MTTMAC, molten at about 75° C., in a premix vessel. This premix is then added with high shear mixing to a mix vessel containing deionized water, at about 70° C., antifoaming agent, and a small amount of concentrated HCl to adjust the pH of the composition to about 2.8–3.0. When the mixture is thoroughly mixed, the polydimethylsiloxane emulsion, Kathon CG preservative, and $CaCl_2$ are added; and then allowed to cool to about 40° C. when free Perfume C is added with mixing. The mixture is allowed to cool further to foom tempeature.

| Components | Example 12 (Wt. %) | Comparative Example 13 (Wt. %) |
|---|---|---|
| DTDMAC | 4.22 | 4.54 |
| TTI | 3.15 | 3.40 |
| MTTMAC (46%) | 0.53 | 0.57 |
| Perfume C | — | 0.38 |
| Protected Complex Particles 4 | 7.00 | — |
| Minor Ingredients | 0.19 | 0.20 |
| Kathon CG (1.5%) | 0.03 | 0.03 |
| Hydrochloric Acid | to pH 2.8 | to pH 2.8 |
| Deionized Water | Balance | Balance |
| | 100.00 | 100.00 |

EXAMPLE 14

A homogeneous mixture of cetyltrimethylammonium bromide (CTAB) and sorbitan monostearate (SMS) is obtained by melting SMS (about 165 g) and mixing CTAB (about 55 g) therein. The solid softener product is prepared from this "co-melt" by one of two methods: (a) cryogenic grinding (−78° C.) to form a fine powder, or (b) prilling to form 50–500 μm particles.

Cryogenic Grinding:

The molten mixture is frozen in liquid nitrogen and ground in a Waring blender to a fine powder. The powder is placed in a dessicator and allowed to warm to room temperature, yielding a fine, free flowing powder (granule).

Prilling

The molten mixture (~88° C.) falls ~1.5 inches at a rate of about 65 g/min. onto a heated (~150° C.) rotating (~2,000 rpm) disc. As the molten material is spun off the disk and air cooled (as it radiates outward), near-spherical granule particles (50–500 μm) form.

About b 125 g of the Protected Complex Particles I are added to and intimately mixed with about 100 g of the solid particulate softener composition to from a complete perfumed product.

The solid particles are dispersed in warm water (40° C., 890 g) and vigorously shaken for approximately 1 minute to form a conventional liquid fabric softener product. Upon cooling, the aqueous product remains in a homogeneous emulsified, or dispersed, state. Addition of the liquid product to the rinse cycle of a washing process provides excellent softness, substantivity, and antistaic characteristics. The product also gives to the treated fabrics a "rewet" perfume benefit.

EXAMPLE 15

A detergent composition is prepared by mixing about 10 parts of the Protected Complex Particles I with 90 parts of the following granular detergent composition:

| Ingredient | Parts |
|---|---|
| Na $C_{13}$ linear alkyl benzene sulfonate | 8.5 |
| Na $C_{14}$–$C_{15}$ fatty alcohol sulfate | 8.5 |
| Ethoxylated $C_{12}$–$C_{13}$ fatty alcohol | 0.05 |
| $Na_2SO_4$ | 29.8 |
| Sodium silicate (1.6 r) | 5.5 |
| Polyethylene glycol (M.W. 8,000) | 0.5 |
| Sodium polyacrylate | 1.2 |
| Sodium tripolyphosphate | 5.6 |
| Sodium pyrophosphate | 22.4 |
| $Na_2CO_3$ | 12.3 |
| Optical brightener | 0.2 |
| Protease enzyme (Alcalase) | 0.7 |
| Moisture | 3.3 |
| Sodum toluene/Xylene sulfonate | 1.0 |
| Total | 100.0 |

EXAMPLE 16

Alternate granular detergent compositions are prepared by mixing about 15 parts of the Protected Complex Particles I with about 85 parts of the following granular detergent composition:

| Ingredient | Parts |
|---|---|
| Na $C_{13}$ linear alkyl benzene sulfonate | 11.5 |
| Na $C_{14}$–$C_{15}$ fatty alcohol sulfate | 11.5 |
| Ethoxylated $C_{12}$–$C_{13}$ fatty alcohol | 1.9 |
| $Na_2SO_4$ | 14.0 |
| Sodium silicate (1.6 r) | 2.3 |
| Polyethylene glycol (M.W. 8,000) | 1.8 |
| Polyacrylic acid (M.W. 1,200) | 3.5 |
| Hydrated Zeolite A (~2 microns) | 28.9 |
| $Na_2CO_3$ | 17.0 |
| Optical brightener | 0.2 |
| Protease enzyme (Alcalase) | 0.6 |
| Moisture and Miscellaneous | 7.0 |
| Total | 100.2 |

Fabric Treatment

Each laundry load is washed is an automatic washer with about 100 g of granular detergent composition of Example 15 or Example 16 is about 20 gal. of cold water. The wet washed laundry load is transferred to an automatic electric laundry tumble dryer and dried at a temperature of about 70° C. The resulting dried fabric has low initial perfume odor, but when wetted by spraying with a mist of water, a definite fragrance bloom is obtained.

What is claimed is:

1. A solid, particulate fabric softener composition comprising:

I. from about 20% to about 90% fabric softener; and

II. from about 5% to about 80% of cyclodextrin/perfume complex in the form of protected particles that are protected by solid, substantially water-insoluble protective material that melts at a temperature between about 30° C. and about 90° C., the said material being from about 50% to about 1,000% by weight of said cyclodextrin/perfume complex.

2. The composition of claim 1 wherein said protected particles II have an average diameter between about 1 and about 1,000 microns.

3. The composition of claim 2 wherein said average diameter is between about 5 to about 500 microns.

4. The composition of claim 1 wherein said average diameter is from about 5 to about 250 microns.

5. The composition of claim 4 wherein said material melts within the range from about 30 to about 90° C.

6. The composition of claim 5 wherein said material melts within the range from about 35 to about 80° C.

7. The composition of claim 1 wherein said protective material melts within the range from about 30 to about 90° C.

8. The composition of claim 7 wherein said protective material melts within the range from about 35 to about 80° C.

9. The composition of claim 1 in which said protective material is substantially non-water-swellable.

10. The composition of claim 1 wherein said protective material is from about 100% to about 500% by weight of said cyclodextrin/perfume complex.

11. The composition of claim 1 wherein said protective material is from about 150% to about 300% by weight of said cyclodextrin/perfume complex.

12. A solid, particulate fabric softener composition comprising:

I. from about 30% to about 70% fabric softener; and

II. from about 10% to about 70% of cyclodextrin/-perfume complex in the form of protected particles that are protected by solid, substantially water-insoluble protective material that melts at a temperature between about 30° C. and about 90° C., the said material being from about 50% to about 1,000% by weight of said cyclodextrin/perfume complex.

13. The process of treating fabrics in a rinse cycle of a laundry process with the composition of claim 1 followed by drying said fabrics in an automatic laundry dryer to provide said fabrics with a rewet odor benefit.

* * * * *